US006739853B1

(12) United States Patent
Tang et al.

(10) Patent No.: US 6,739,853 B1
(45) Date of Patent: May 25, 2004

(54) COMPACT CONTROL MECHANISM FOR AXIAL MOTION CONTROL VALVES IN HELICAL SCREW COMPRESSORS

(75) Inventors: Yan Tang, Daphne, AL (US); Bruce A. Fraser, Manlius, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/313,722

(22) Filed: Dec. 5, 2002

(51) Int. Cl.[7] ..... F04C 18/00

(52) U.S. Cl. ..... 418/201.2; 418/201.1; 418/180; 418/87; 137/115.06

(58) Field of Search ..... 418/201.2, 201.1, 418/87, 88, 180; 137/115.06

(56) References Cited

U.S. PATENT DOCUMENTS 3,146,720 A * 9/1964 Henry ..... 137/115.06
3,734,653 A * 5/1973 Edstrom et al. ..... 418/201.2
3,936,239 A * 2/1976 Shaw ..... 418/201.2
4,005,949 A * 2/1977 Grant ..... 418/201.2
4,544,333 A * 10/1985 Hirano ..... 418/201.2
5,183,395 A * 2/1993 Langouet ..... 418/201.2

* cited by examiner

*Primary Examiner*—Thomas Denion
*Assistant Examiner*—Theresa Trieu

(57) ABSTRACT

An axial slide valve is provided with an axially extending fluid chamber at each end with one chamber receiving a spring and being acted on by suction pressure and the other chamber coacting with a fixed piston and being acted upon by discharge pressure or the like whereby the slide valve is positioned so as to balance the spring and fluid pressures and thereby the compressor capacity.

11 Claims, 5 Drawing Sheets

COMPACT CONTROL MECHANISM FOR AXIAL MOTION CONTROL VALVES IN HELICAL SCREW COMPRESSORS

BACKGROUND OF THE INVENTION

Positive displacement compressors in air conditioning and refrigeration applications are normally operated over a range of capacities and thus require some means for modifying their operation if efficient operation is to be maintained. It is desirable to be able to unload a compressor to various percentages of capacity in fixed increments, or continuously, over an entire range. Simultaneously, it is desirable to efficiently maintain the discharge pressure to suction pressure ratio, or $V_i$, for meeting system requirements. To meet these various requirements, a number of individual controls are used. In the case of helical screw compressors, for example, capacity control is conventionally achieved by the use of a slide valve. The slide valve is located in and slides axially in the cusp of the housing formed between the intersecting bores of the two rotors. The slide valve thus defines a portion of each bore and thereby compromises the integrity of the housing as well as making for a complicated device. The slide valve is reciprocatably positionable with respect to the axes of the rotors and can thus effectively change the start of compression by changing the closing point of the suction volume and thereby controlling the amount of gas trapped and compressed. Axial type slide valves can also be placed in various positions around the rotor bores defining a portion of one bore only. Additionally, axial slot valves displaced from the rotor bores are used.

SUMMARY OF THE INVENTION

An axial slide valve is provided with an axially extending fluid chamber at each end of the slide valve such that the slide valve is acted on by fluid pressure during compressor operation and may always be biased towards an open or unloaded position by a spring. Typically, the force of the spring acts in conjunction with suction pressure in one of the chambers in opposition to the discharge pressure or pressure supplied by a lubricating pump, or the like, to the opposing chamber which is sealed by a fixed piston. At start up, with the fluid pressures balanced, the spring bias will act on the slide valve to position it in a position corresponding to the lowest compressor capacity which makes starting the compressor easier. As the discharge pressure or the lubricating pump pressure builds up in the opposing chamber and acts on the valve causing it to move against suction pressure and the spring bias, the spring is thereby compressed and the valve increases the volume available for compressing gas. The force differential acting on the valve will determine the position of the valve and thereby the magnitude of the trapped volumes and thus the pumping capacity of the compressor. Because the fluid chambers are located within the slide valve and provide the location for the spring and fixed piston, the control structure is very compact.

It is an object of this invention to provide a compact control mechanism for axial slide valves.

It is an additional object of this invention to provide $V_i$ control for partial load operation of an air conditioning compressor.

It is another object of this invention to provide automatic unloading for a compressor at start up.

It is a further object of this invention to increase the minimum required rotational speed for variable speed screw compressors.

It is an additional object of this invention to automatically achieve optimum $V_i$ to match up the pressure differential for partial loading. These objects, and others as will become apparent hereinafter, are accomplished by the present invention.

Basically, an axial slide valve is provided with an axially extending fluid chamber at each end with one chamber receiving a spring and being acted on by suction pressure and the other chamber coacting with a fixed piston and being acted upon by discharge pressure, or the like, whereby the slide valve is positioned so as to balance the spring and fluid pressures and thereby regulate the compressor capacity.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
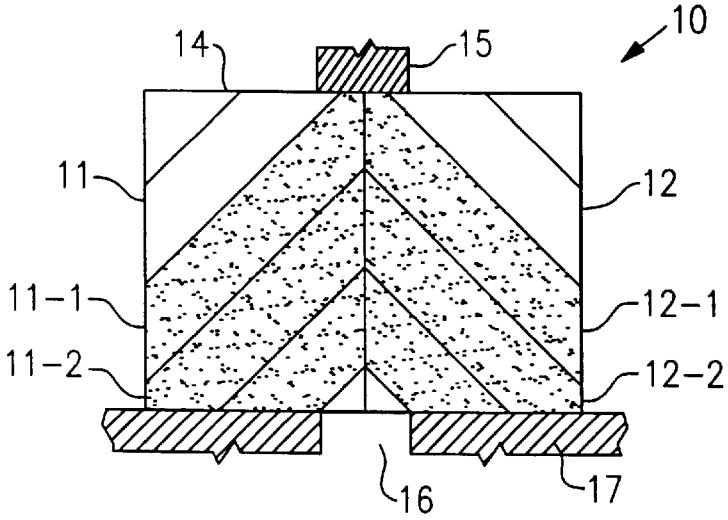
FIG. 1 shows unwrapped rotors and the trapped volumes at full load.
Figure 2:
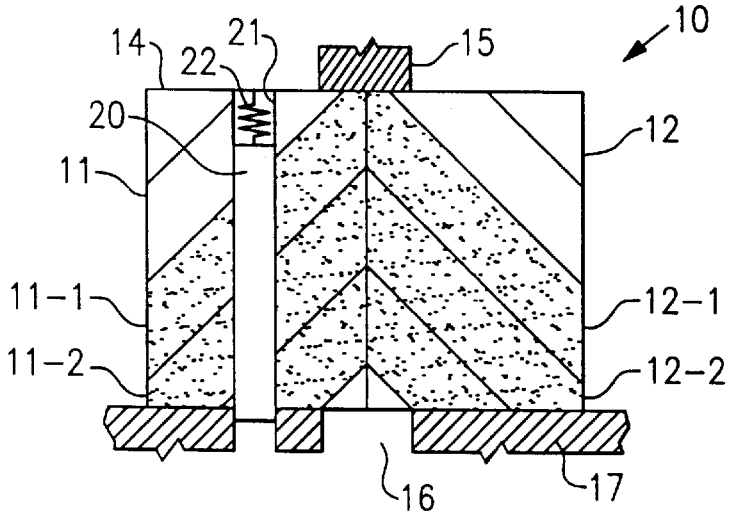
FIG. 2 is the same as FIG. 1, but has the slide valve of the present invention in the closed or fully load position superimposed thereon.

In FIG. 1, the numeral 10 designates a twin screw helical compressor. The numeral 11 represents the unwrapped male rotor and the numeral 12 represents the unwrapped female rotor. Axial suction port 14 is located in end wall 15 of the compressor housing and axial discharge port 16 is located in end wall 17 of the compressor housing. The stippling represents the chevron shaped trapped volumes of refrigerant starting with the cutoff of suction port 14 and progressing to a point just prior to communication with axial discharge port 16. As illustrated, compressor 10 is operating at full load. FIG. 2 is the same as FIG. 1 except that slide valve 20 and its bore 21 and spring 22 have been superimposed on male rotor 11. In FIG. 2, as in FIG. 1, compressor 10 is operating at full load.

Figure 3:
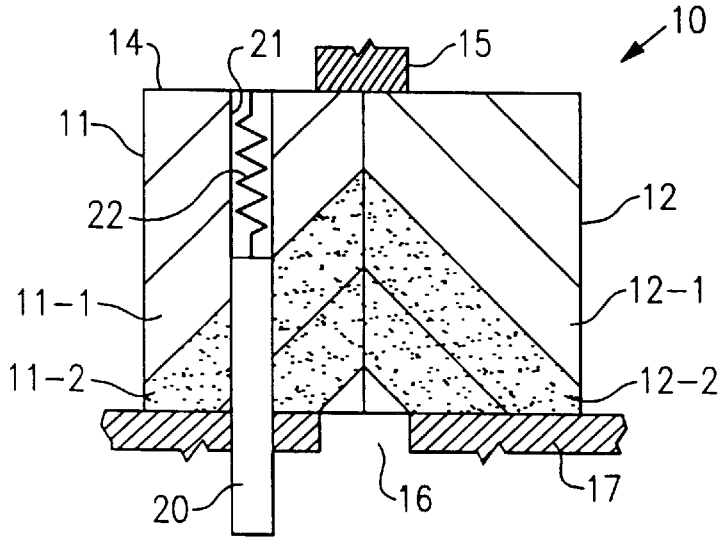
FIG. 3 is the same as FIG. 2 except that the slide valve is moved to a partial load position providing fluid communication between suction and some otherwise trapped volumes.

In FIG. 3, slide valve 20 has been moved in its bore 21 by spring 22 coacting with the pressure differential across slide valve 20 so as to connect a portion of bore 21 with suction port 14 such that the groove 11-1 which corresponds to a trapped volume in FIGS. 1 and 2 communicates with suction port 14 via bore 21. Groove 12-1 in female rotor 12 is in fluid communication with groove 11-1 with which it makes a chevron shaped cavity and is in fluid communication with suction port 14 via groove 11-1 and bore 21. Ports 14 and 16 have been designated axial ports in FIGS. 1–3 in order to illustrate them relative to the unwrapped rotors 11 and 12. Ports 14 and 16 can have a radial component as will be clear from FIGS. 4–9.

Referring to FIGS. 4–8, it will be noted that slide valves 20 and 20' are cylindrical with axially extending grooves 20-a and 20-a', respectively, forming a part of male rotor bore 10-1 and female rotor bore 10-2, respectively. Valve 20 has two cylindrical cavities or chambers, 20-1 and 20-2, separated by a wall, or partition, 20-3 at a location, nominally, mid length of slide valve 20. Cylindrical cavities 20-1 and 20-2 may have the same or different diameters. As illustrated, cavity 20-1 has a diameter of D1 and cavity 20-2 has a diameter of D2. Cylindrical cavities or chambers 20-1 and 20-2 are eccentric, rather than coaxial, with respect to the cylinder defining slide valve 20 due to the presence of groove 20-a which would make the wall of cavities 20-1 and 20-2 too thin in the region of grove 20-a if the cavities were coaxial. Male rotor 11 is located in compressor housing bore 10-1 and female rotor 12 is located in compressor housing bore 10-2. Slide valve 20 reciprocates in bore 21 relative to fixed piston 30 which is received in cavity 20-2 and is sealed with respect to cavity 20-2 by seal 32. Bore 30-1 in piston 30 provides the sole fluid communication with cavity 20-2 and supplies discharge or other pressurized fluid to chamber 20-2 where it acts on partition 20-3 and tends to move slide valve 20 to the FIG. 5 position. On shut down, bore 30-1 permits the release of pressure from chamber 20-2 to achieve fluid pressure equalization. If necessary, or desired, a spring support or guide 40 can be threadably or otherwise suitably secured to the valve stop 24 or the compressor housing and to extend into cavity 20-1. Cavity 20-1 is in fluid communication with the suction end 20-6 of slide valve 20. Spring 22 loosely surrounds guide 40 and extends into cavity 20-1 where it provides a bias force on wall 20-3 in opposition to the fluid pressure in cavity 20-2 acting on wall 20-3 and in conjunction with the suction pressure in chamber 20-1 acting on wall 20-3 and on the suction end 20-6 of slide valve 20.

Figure 4:
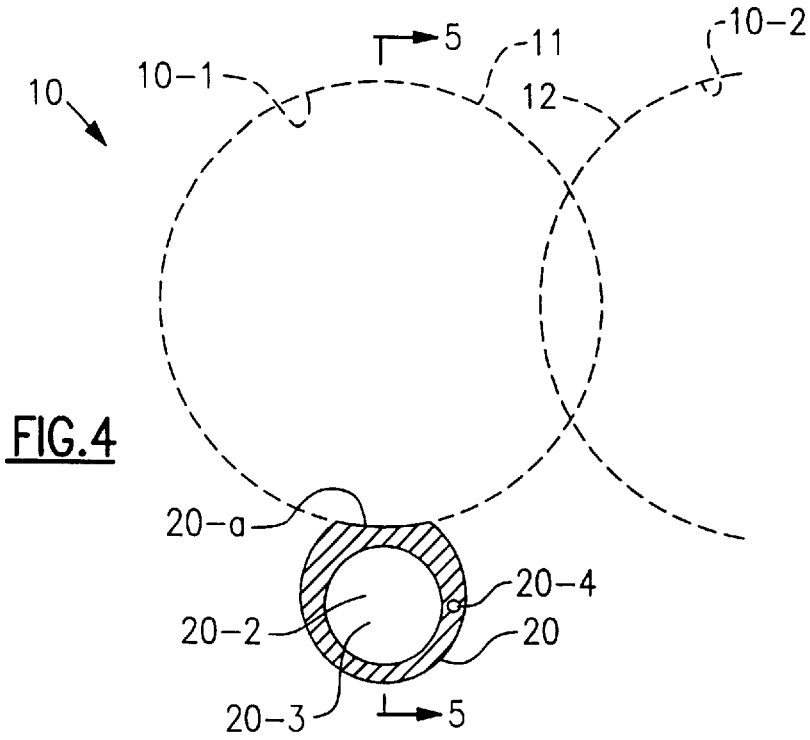
FIG. 4 is a sectional view taken along line 4—4 of FIG. 5.
Figure 5:
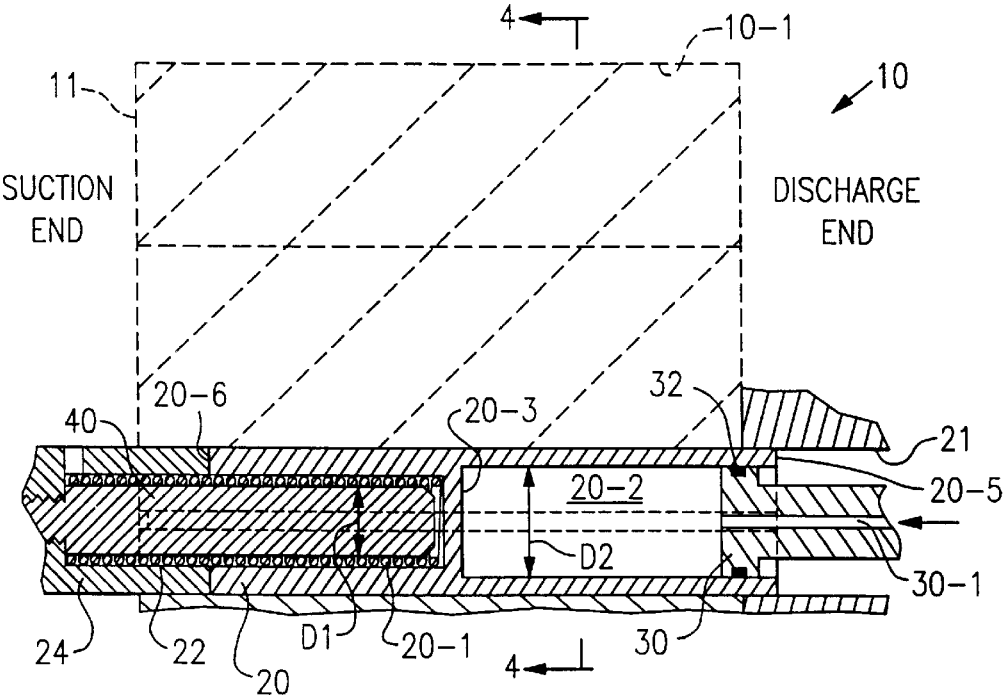
FIG. 5 is a sectional view taken along line 5—5 of FIG. 4 showing the slide valve in the fully loaded position.
Figure 6:
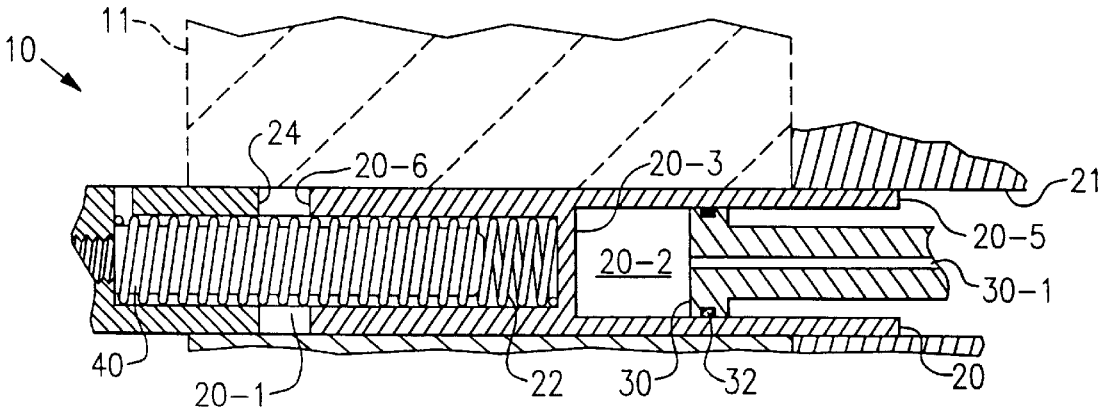
FIG. 6 is the same as FIG. 5 except that the slide valve is in a partially loaded position.

In the FIG. 5 position, fluid pressure in cavity 20-2 acting on wall 20-3 is sufficient to overcome the combined force of spring 22 and the fluid pressure in cavity 20-1 such that suction end 20-6 of slide valve 20 is held in contact with valve stop 24. So, FIG. 5 illustrates the fully loaded position of slide valve 20. As best shown in FIG. 4, one, or more bores 20-4 may be provided and extend the length of slide valve 20 so as to provide a pressure balance on the ends 20-5 and 20-6 of the slide valve 20. If bore 20-4 is not present, discharge pressure, typically, will act on discharge end 20-5 radially outward of fixed piston 30. Specifically, the fluid pressure acting on slide valve 20 tending to move it in bore 21 is suction pressure in one direction and the pressure in chamber 20-2 as well as the pressure on the discharge end 20-5 of valve 20 radially outward of fixed piston 30 in the opposing direction. When the pressure in chamber 20-2 and pressure on discharge end 20-5 are insufficient to hold valve 20 in engagement with valve stop 24, valve 20 will move to a position corresponding to that of FIGS. 3 and 6 which corresponds to a partially loaded position of valve 20. In going from the FIG. 5 position to the FIG. 6 position, fluid is discharged from chamber 20-2 via bore 30-1 so as to permit movement of slide valve 20. In the FIG. 3 and 6 positions of slide valve 20, grooves 11-1 and 12-1 which would otherwise be trapped volumes are in fluid communication with suction inlet 14, as described above, and are unable to undergo compression. With fewer trapped volumes, less refrigerant is compressed and the compressor capacity is reduced.

For compressor start up, slide valve 20 is in a position corresponding to the least loaded position since there will be no suction to discharge pressure differential, as such, and fluid pressures will be balanced such that the spring bias of spring 22 will move slide valve 20 to the most extreme position permitted by either a physical barrier or the full extension of spring 22. As discharge pressure or lubricant pressure builds up and is supplied to chamber 20-2, slide valve 20 will move to the left, as to the position illustrated in FIG. 6, thereby causing compressor loading, which is determined by the balance between fluid pressure in chamber 20-2 and the pressure on discharge end 20-5 opposing the suction pressure and spring bias acting in chamber 20-1 and on suction end 20-6. If the pressure on end 20-5 and in chamber 20-2 is sufficient to overcome the pressure on end 20-6 and the spring bias, slide valve 20 will be moved into contact with valve stop 24, the fully loaded position, as illustrated in FIG. 5. For partial loading condition, the reduced pressure in chamber 20-2 and the relocated slide valve 20 produces a new $V_i$ which matches the reduced pressure ratio.

The areas of wall, or partition, 20-3 acted on by the pressures in chambers 20-1 and 20-2 need not be equal. The pressure in chamber 20-2 can be controlled by pilot hydraulic or pneumatic pressure, in order to maintain a constant pressure differential across wall 20-3 for partial loading. If desired, piston 30 can be eliminated. With a sufficient seal, pilot pressure could then act on the discharge end 20-5 of slide valve 20.

With the length of bores 10-1 and 10-2 fixed by compressor design and the movement of axial slide valve 20 determined by the degree of unloading required for capacity control, it will be noted that the present invention requires little, if any, space beyond that required by valve 20. Accordingly, the present invention provides a compact control mechanism for valve 20.

Figure 7:
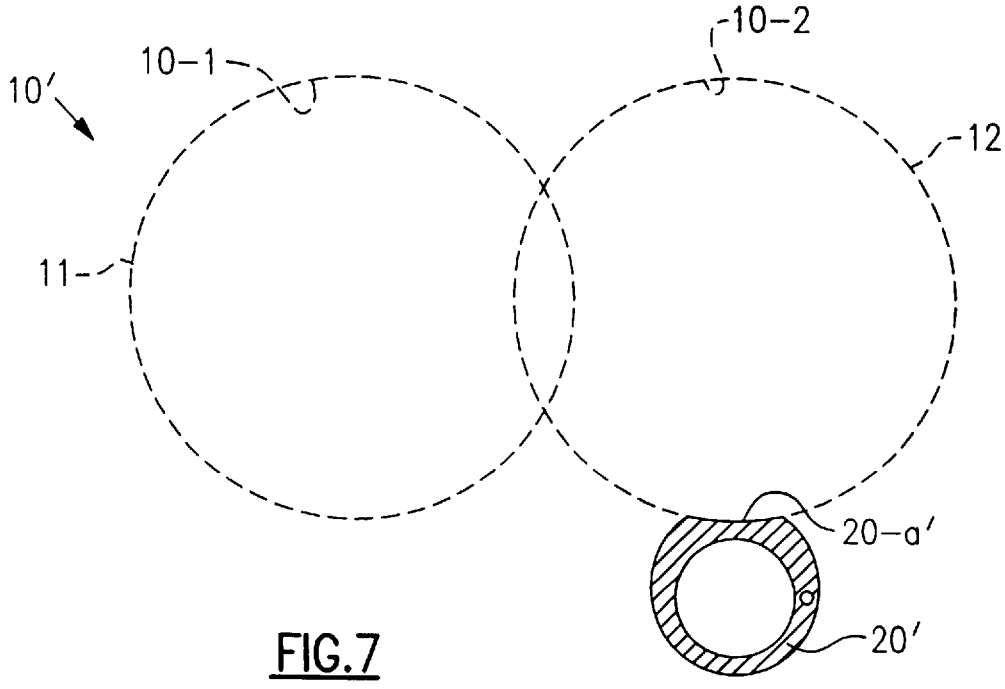
FIG. 7 is a discharge end sectional view of a first modified embodiment where the slide valve is located in the female rotor bore.

FIG. 7 differs from FIG. 4 in that slide valve 20' of compressor 10' coacts with female rotor 12 rather than male rotor 11. Structurally and functionally, slide valve 20' is the same as slide valve 20. Otherwise, the operation of slide valve 20' and compressor 10' is the same as that of the device of FIGS. 4–6.

Figure 8:
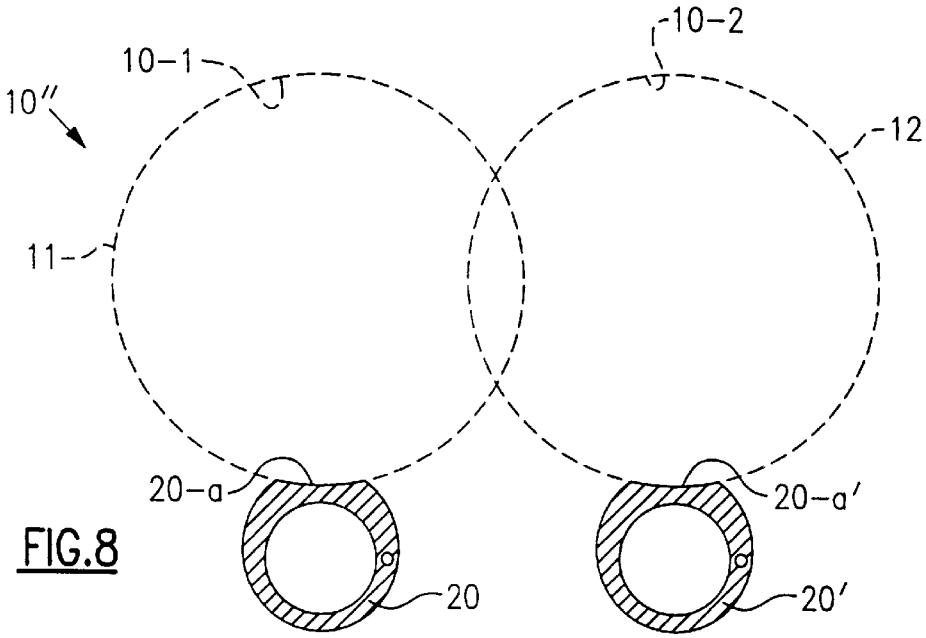
FIG. 8 is a discharge end sectional view of a second modified embodiment where slide valves are located in both the male and female bores.

The FIG. 8 device is a combination of the FIG. 4 and the FIG. 7 devices. Compressor 10" has both slide valve 20 and slide valve 20' coacting with male rotor 11 and female rotor 12, respectively. The slide valves 20 and 20' operate in the same manner as slide valve 20 of the device of FIGS. 4–6.

Figure 9:
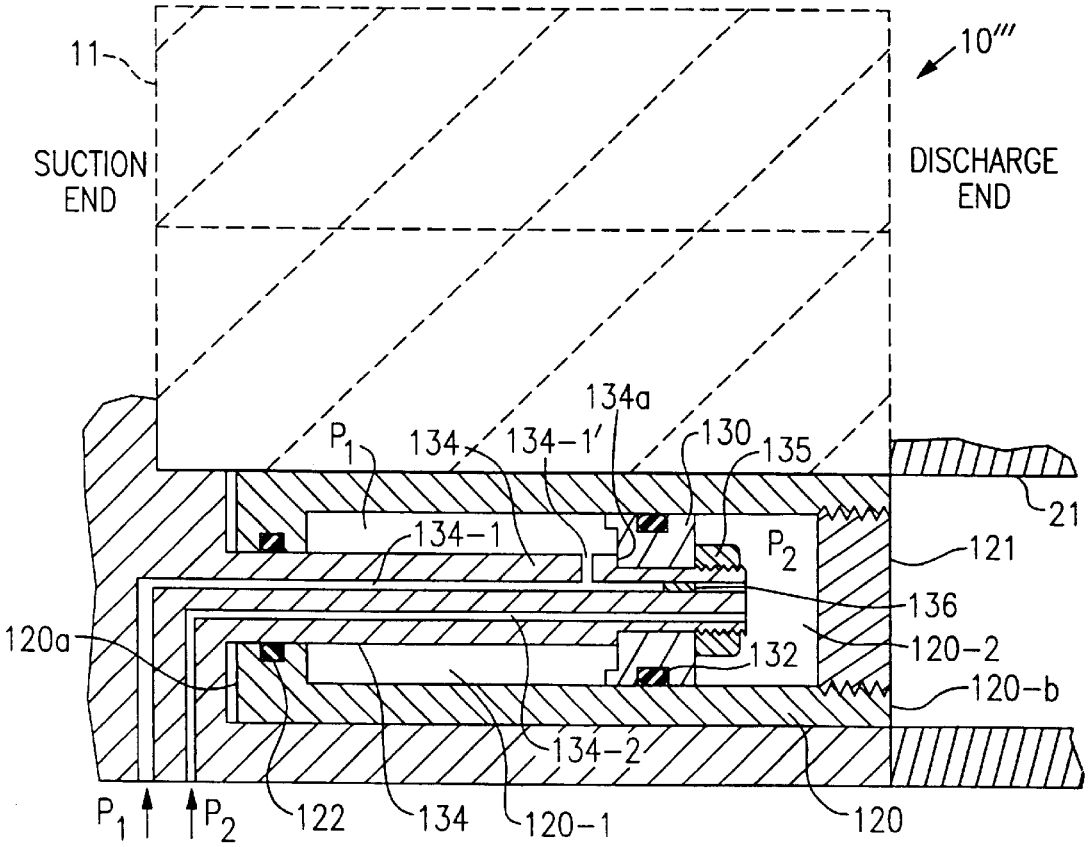
FIG. 9 is a sectional view of a fourth modified embodiment showing the modified slide valve utilizing a dual piston actuator and located in the fully loaded position.

The embodiment of FIG. 9 differs from the other embodiments in that it can be controlled totally by pressure and spring 22 can therefore be eliminated. Slide valve 120 of compressor 10'" has a sealed cavity which is divided into two sealed chambers, 120-1 and 120-2, by fixed piston 130 which carries seal 132. Plug 121 is threadably received in slide valve 120 to partially define chamber 120-2 as well as coacting with slide valve 120 to define discharge end 120-b of slide valve 120. Fixed piston 130 is held in place against shoulder 134*a* of rod 134 by nut 135. Rod 134 has axial passage 134-1 and radial passage 134-1' communicating with sealed chamber 120-1 for supplying fluid at pressure $P_1$. Axial passage 134-1 is sealed by plug 136. Axial passage 134-2 communicates with sealed chamber 120-2 for supplying fluid at pressure $P_2$. Seal 122 seals between slide valve 120 and rod 134. Because rod 134 extends through suction end 120-a of slide valve 120, fluid pressure acts on a greater area at the discharge end 120-b of the slide valve 120 than at the suction end 120-a. Also, since rod 134 extends through chamber 120-1, the area of end 120-a of slide valve 120 exposed to the pressure in chamber 120-1 is less than the area of end 120-b of slide valve 120 and plug 121 exposed to the pressure in chamber 120-2. Ends 120-a and 120-b will be exposed to suction and discharge pressures, respectively, during operation and by the same pressure upon pressure equalization after shut down.

Figure 10:
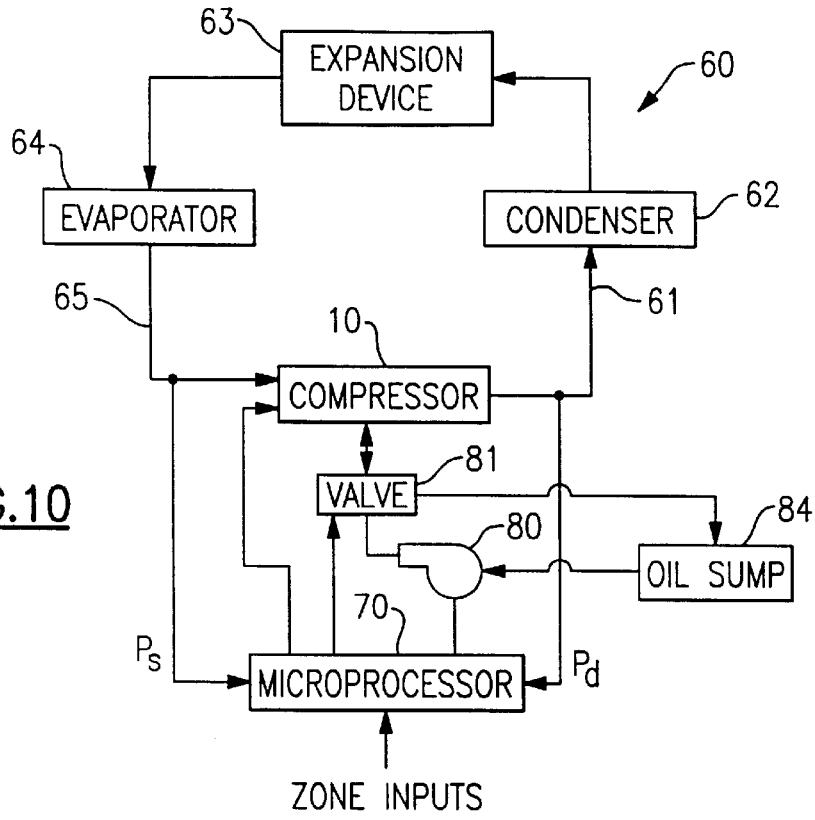
FIG. 10 is a schematic representation of an air conditioning or refrigeration system employing the compressor of FIGS. 4–6.

In FIG. 10, the numeral 60 generally indicates a refrigeration or air conditioning system. Compressor 10 is in a circuit serially including discharge line 61, condenser 62, expansion device 63, evaporator 64 and suction line 65. System 60 is controlled by microprocessor 70. The microprocessor 70 receives a series of inputs including the suction pressure, $P_S$, the discharge pressure, $P_d$, and zone requirements collectively labeled as zone inputs. Assuming the pressure is being supplied to chamber 20-2 via bore 30-1 from an external source rather than supplying discharge pressure to chamber 20-2, then a pump 80 will be required. Microprocessor 70 will cause the operation of compressor 10 and will control its capacity through pump 80 and 3-way valve 81 which will supply pressurized fluid to chamber 20-2 at a pressure determined by microprocessor 70 responsive to its inputs. The microprocessor 70 will also control the release of pressurized fluid through 3-way valve 81 back to oil sump 84 responsive to the inputs to microprocessor 70 to permit movement of valve 20 to central loading and to permit pressure release at shut down to move the valve to the unloaded position. Compressor 10' would be controlled the same as compressor 10. Compressor 10" would require the simultaneous supplying of fluid pressure to valves 20 and 20'.

Figure 11:
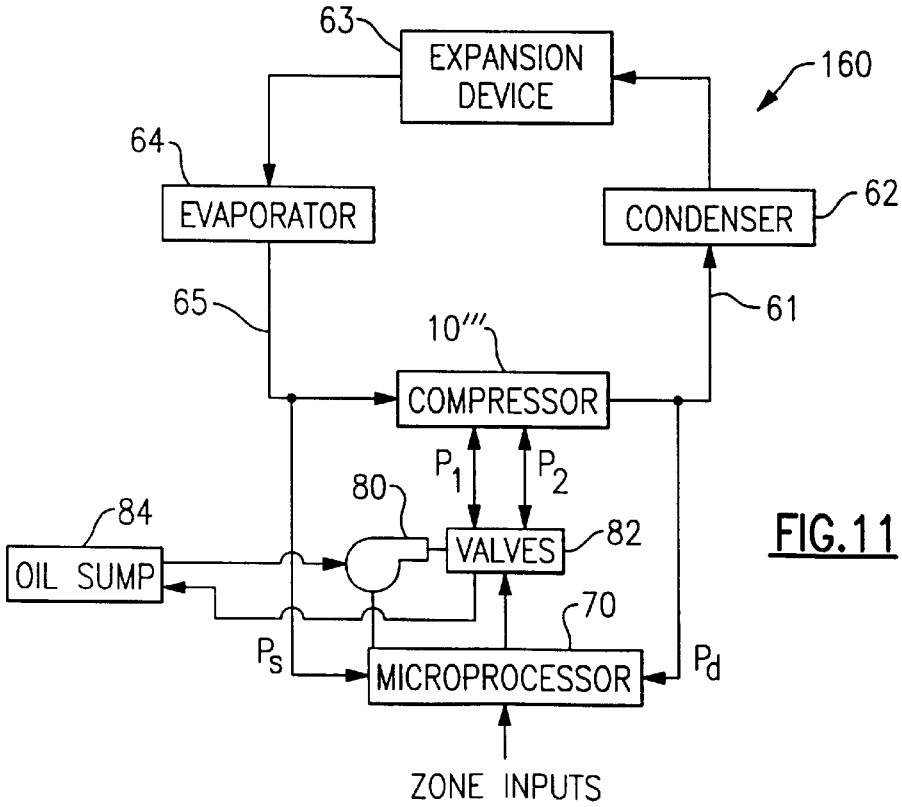
FIG. 11 is a schematic representation of an air conditioning or refrigeration system employing the compressor of FIG. 9.

Refrigeration system 160 of FIG. 11 differs from system 60 of FIG. 10 in that compressor 10'" is being employed and a series of valves 82 is located downstream of pump 80. Pump 80 is controlled by microprocessor 70 to supply either pressure at $P_1$ to chamber 120-1 or pressure at $P_2$ to chamber 120-2 as is required to position valve 120. The series of valves 82 is controlled by microprocessor 70 in conjunction with the control of pressures $P_1$ and $P_2$ to release pressure $P_1$ or $P_2$ in response to its inputs to thereby permit the movement of valve 120. Due to the opposing differential areas of valve 120 acted on by the fluid pressures, at shut down, the valve 120 should be moved to the fully unloaded position before permitting the opening of valves 82 to permit pressure equalization. It will be noted that suction and discharge pressure, respectively, act externally on ends 120-a and 120-b of valve 120 in conjunction with the pressure in chambers 120-1 and 120-2.

Fluid (oil) pump 80 must be able to supply pressurized fluid to chamber 120-2 at pressure greater than the discharge pressure of compressor 10'". At shut down, after pressure equalization, nominal suction pressure will be acting on ends 120-a and 120-b and the pressures $P_1$ and $P_2$ in chambers 120-1 and 120-2, respectively, will be allowed to equalize. Because of the differential areas acted on by the fluid pressures, slide valve 120 will be moved to the right as illustrated in FIG. 9. to the unloaded position for start up.

After compressor 10'" is started, pressure $P_1$ and $P_2$ can remain equalized until increased capacity is desired. At this point, $P_1$ can be increased, $P_2$ can be decreased or there may be a combination of both. If discharge pressure acts on end 120-b in the unloaded position, then $P_1$ will have to be controlled to a higher pressure via pump 80. If the equivalent of bore 20-4 of FIG. 4 is employed and suction pressure is in chamber 120-2, discharge pressure supplied to chamber 120-1 can be used to attain the intermediate control pressures to properly locate slide valve 120. If discharge pressure acts on end 120-b after start up, $P_2$ will have to increase with increasing discharge pressure to maintain an unloaded position. As $P_2$ is decreased, compressor 10'" will start to load. Seal 122 and the source of $P_1$ can be eliminated if discharge pressure is acting on 120-b and suction pressure is in 120-1.

Although preferred embodiments of the present invention have been illustrated and described, other modifications will occur to those skilled in the art. For example, the embodiment of FIG. 9 can be modified by eliminating seal 122, bores 134-1, and 134-1', supplying suction pressure to chamber 120-1 and placing a spring in chamber 120-2. It is therefore intended that the present invention is to be limited only by the scope of the appended claims.

What is claimed is:

1. A screw compressor including:

a housing with a pair of overlapping bores in the housing;

a pair of interengaging rotors located in said bores;

a slide valve having first and second ends and forming a part of only one of said overlapping bores;

said slide valve having a cavity therein;

a fixed piston located in said cavity and forming at least one pressure chamber in said cavity;

said slide valve being reciprocatable with respect to said fixed piston;

means for supplying pressurized fluid to said at least one pressure chamber;

pressure acting on said slide valve in opposition to said pressurized fluid in said pressure chamber whereby said slide valve is positioned responsive to a pressure differential to control the capacity of said compressor.

2. The screw compressor of claim 1 wherein said fixed piston coacts with said cavity to define a second pressure chamber.

3. The screw compressor of claim 2 further including means for supplying pressurized fluid to said second one of said two pressure chambers.

4. The screw compressor of claim 3 wherein said fixed piston is secured to a rod and said means for supplying pressurized fluid to each of said pressure chambers is at least partially located in said rod.

5. The screw compressor of claim 4 wherein said first and second ends of said slide valve are acted on by fluid pressure.

6. The screw compressor of claim 1 wherein said first and second ends of said slide valve are acted on by fluid pressure.

7. The screw compressor of claim 6 further including means for biasing said slide valve towards an open position.

8. A screw compressor including:

a housing with a pair of overlapping bores in the housing;

a pair of interengaging rotors located in said bores;

a slide valve having first and second ends and forming a part of only one of said overlapping bores;

said slide valve having a cavity therein;

a fixed piston located in said cavity and forming only one pressure chamber in said cavity;

said slide valve being reciprocatable with respect to said fixed piston;

means for supplying pressurized fluid to said pressure chamber;

pressure acting on said slide valve in opposition to said pressurized fluid in said pressure chamber whereby said slide valve is positioned responsive to a pressure differential to control the capacity of said compressor.

9. The screw compressor of claim 8 wherein said first and second ends of said slide valve are acted on by fluid pressure.

10. The screw compressor of claim 9 further including means for biasing said slide valve towards an open position.

11. The screw compressor of claim 8 wherein said fixed piston is secured to a rod and said means for supplying pressurized fluid to said pressure chamber is at least partially located in said rod.

* * * * *